US006428022B1

(12) United States Patent
Namiki

(10) Patent No.: US 6,428,022 B1
(45) Date of Patent: Aug. 6, 2002

(54) INLINE SKATEBOARD

(76) Inventor: Yoshi Namiki, 933 Brandon Ave., Simi Valley, CA (US) 93065

( * ) Notice: Subject to any disclaimer, the term of this patent is extended or adjusted under 35 U.S.C. 154(b) by 0 days.

(21) Appl. No.: 09/458,723

(22) Filed: Dec. 13, 1999

(51) Int. Cl.[7] ..... B62M 1/00
(52) U.S. Cl. ..... 280/87.042; 280/268
(58) Field of Search ..... 280/11.23, 11.28, 280/87.042, 11.25, 11.27, 87.01, 87.021, 87.041, 268, 271, 11.22; 16/18 A; 301/5.3, 5.7

(56) References Cited

U.S. PATENT DOCUMENTS

| | | | | | |
|---|---|---|---|---|---|
| D150,401 | S | * | 8/1948 | Brickson | 280/87.042 X |
| 3,362,722 | A | * | 1/1968 | Core | 280/87.042 |
| 3,795,409 | A | * | 3/1974 | Cudmore | 280/87.042 |
| 3,995,873 | A | * | 12/1976 | Pantzar | 280/11.28 X |
| 4,071,256 | A | * | 1/1978 | Kimmell | 280/11.28 |
| 4,168,842 | A | * | 9/1979 | Kimmell et al. | 280/11.28 |
| 4,180,278 | A | * | 12/1979 | Gottleib | 280/87.042 |
| 4,208,073 | A | * | 6/1980 | Hechinger | 301/5.3 |
| 4,212,093 | A | * | 7/1980 | Lombard | 280/271 X |
| 5,443,277 | A | * | 8/1995 | Kubierschky | 301/5.7 X |
| 5,566,956 | A | * | 10/1996 | Wang | 280/87.041 X |
| 5,676,428 | A | * | 10/1997 | St. Laurent | 301/5.3 |
| 5,769,432 | A | * | 6/1998 | Tybinkowski et al. | 301/5.3 |
| 5,803,473 | A | * | 9/1998 | Bouden | 280/87.042 |
| 5,826,895 | A | * | 10/1998 | Bradfield | 280/87.042 |
| 5,868,408 | A | * | 2/1999 | Miller | 280/87.042 |
| 5,984,328 | A | * | 11/1999 | Tipton | 280/87.042 |
| D418,890 | S | * | 1/2000 | Wilson | |
| 6,267,394 | B1 | * | 7/2001 | Bouden | 280/87.042 |

FOREIGN PATENT DOCUMENTS

| | | | |
|---|---|---|---|
| WO | WO 90/00428 | * | 1/1990 |

* cited by examiner

*Primary Examiner*—Brian L. Johnson
*Assistant Examiner*—Bryan Fischmann
(74) *Attorney, Agent, or Firm*—Robert J. Schaap

(57) ABSTRACT

An inline skateboard capable of being propelled by leg motion of a rider and which includes a platform supporting the rider along with a front wheel truck and a rear wheel truck. Each of these wheel trucks carry a single wheel. Moreover, the wheels are capable of slight turning movement transversely with respect to the platform and provide a high degree of maneuverability and turning capability. The wheels on each of the trucks are offset with respect to a pivot axis for each of the trucks. In addition, the axis of rotation of the front wheel is displaced rearwardly of the front pivot axis and the axis of rotation of the rear wheel is displaced forwardly of the rear pivot axis. Further, the angle of displacement of these pivot axes with respect to the axis of rotation is the same. Each of the wheels have relatively flat riding surfaces and relatively flat side walls with arcuate connecting sections extending between the flat side walls and the relatively flat riding surfaces, such that only the outer edges of the wheels are arcuate in shape. This construction provides for highly effective maneuverability and steering capability.

19 Claims, 3 Drawing Sheets

INLINE SKATEBOARD

BACKGROUND OF THE INVENTION

1. Field of the Invention

This invention relates in general to certain new and useful improvements in skateboards having an inline skate wheels and, more particularly, to an inline skateboard in which there is improved maneuverability and turning capability.

2. Brief Description of the Related Art

In most skateboards, front and rear wheel trucks are mounted on the underside of a platform supporting a rider capable of propelling the skateboard by leg motion. Front and rear wheel trucks are used for carrying casters or rollers and usually arranged in pairs on each of the front and rear trucks. Thus, the front wheels would be mounted on a single axle and the same holds true of the rear wheels.

Steering of a skateboard having tandemly arranged wheels on each of the trucks is difficult. Moreover, the front and rear wheels of conventional skateboards rarely are adapted for any turning movement about an axis either perpendicular to or angularly located with respect to, the skateboard and, thus, turning and steering of the skateboard becomes exceedingly difficult. Usually, the wheels or casters are of relatively small diameter, thus further complicating any efficiency in turning. There has been no prior art inline skateboard in which both the front wheels and the rear wheels each have a turning capability in order to enable turning movement of the skateboard.

In order to turn a skateboard, lateral forces are applied to the platform much in the nature of a snow ski. These lateral forces thereby cause the skateboard to rotate in an opposite direction. However, with tandem wheels, which are designed to simultaneously ride upon the ground surface, turning and, hence, the steering of the skateboard is further complicated. There has been proposed several inline skates in which the wheels are located in an inline arrangement. For example, U.S. Pat. No. 5,160,155 to Barachet provides a skateboard having two wheels in tandem with one at the front of the board and the other at the rear of the board.

Additional inline skateboard are taught, for example, in U.S. Pat. No. 5,549,331, dated Aug. 27, 1996, to Yun, et al, and U.S. Pat. No. 5,601,299 to Yun, et al, both for an inline skateboard. In addition, the Wang Pat. No. 5,566,956, dated Oct. 22, 1996, also discloses an inline skateboard. However, in Wang, both of the feet of the rider are positioned side-by-side on the platform of the skateboard. U.S. Pat. No. 5,419,570 to Bollotte also discloses a skateboard having singular inline wheels. In this case, a large number of wheels are mounted on a single truck in an inline arrangement on the underside of a platform.

These inline skateboards which have been taught in the prior art are effective and provide a greater efficiency in turning and maneuverability with a substantial length between front and rear wheel trucks on the skateboard. However, increased length of the skateboard also increases the required amount of experience to use the skateboard properly. In essence, the prior art skateboards which feature inline wheels do not overcome the problems of stability along with turning capability and maneuverability.

In each of the aforesaid prior art patents, each of the wheels are fixedly mounted with essentially no means for turning of the wheels. Any turning motion is achieved only by application of a lateral force to one side of the platform or the other. Thus, when a lateral force is applied to the left side of the platform, a right turning motion is effectuated and when a lateral force is applied to the right side of the platform, a left turning motion is effectuated. However, as indicated above, the necessary efficiency is not achieved with these prior art devices.

There has been one prior art device in which the skateboard has cut outs on the surface of the actual platform so as to permit the wheels to literally project above the surface of the platform. However, this is cumbersome and creates an inherent danger in the use of the device. There has also been a skateboard having a wheel arrangement such that the rider must weight the rear of the skateboard in order to lift up the front of the skateboard and thereby allow turning movement. Here again, this is cumbersome and difficult to use and further creates an inherent risk of injury in the use of the skateboard.

There has been a need for an inline skateboard in which stability is provided, along with increased maneuverability and turning capability. Specifically, there has been a need for a skateboard which permits turning movement by weighting the skateboard much in the same manner as the weighting of a surfboard. Thus, there is a need for a skateboard having a platform with wheels which will steer both in the front of the skateboard and in the rear of the skateboard, but which nevertheless can be controlled to prevent free steering movement of the skateboard.

OBJECTS OF THE INVENTION

It is, therefore, one of the primary objects of the present invention to provide an inline skateboard with increased maneuverability and turning capability and which also still affords a riding stability without substantially increasing the overall size of the skateboard platform.

It is a another object of the present invention to provide an inline skateboard of the type stated in which the wheels of the skateboard are capable of turning relative to the direction of movement of the skateboard in order to further aid in performing a turn on a skateboard.

It is a further object of the present invention to provide an inline skateboard of the type stated in which a lateral application of a force to a skateboard to achieve a turning movement does not cause undue instability in the riding characteristics of the skateboard.

It is an additional object of the present invention to provide an inline skateboard of the type stated which provides an increased riding enjoyment and excitement.

It is another salient object of the present invention to provide an inline skateboard of the type stated in which the wheels of the skateboard are displaced from the pivot axis of the trucks on which the wheels are mounted.

It is still a further object of the present invention to provide an inline skateboard of the type stated in which the wheels are uniquely designed to provide a turning capability in a manner similar to that provided by other two wheel vehicles, such as bicycles and motorcycles.

It is yet another object of the present invention to provide an inline skateboard having a wheel arrangement, such that the maneuverability of the skateboard mimics the action of maneuvering a surfboard.

With the above and other objects in view, my invention resides in the novel features of form, construction, arrangement and combination of parts and components presently described and pointed out in the claims.

SUMMARY OF THE INVENTION

The present invention relates to a skateboard having a unique construction which affords a unique capability in turning and provides substantially increased maneuverability. In addition, unique wheels aid in these turning movements of the skateboard.

The skateboard of the invention comprises a platform for supporting a rider and which enables the skateboard to be propelled by leg motion of this rider. The length of the skateboard is not critical and can range from relatively short skateboards to long skateboards without otherwise compromising the increased maneuverability and turning capability.

In a preferred embodiment, a front wheel truck is secured to an underside of the platform and has a front wheel movable about a front pivot axis passing through the platform. This front pivot axis is at an angle displaced angularly from a vertical pivot axis. An actual point of contact of the front wheel with a ground surface is displaced rearwardly of an imaginary point of contact which would result if the pivot axis were vertically arranged. A rear wheel truck is secured to an underside of the platform and has a rear wheel movable about a rear pivot axis passing through the platform at an angle. This angle is also displaced from a vertical pivot axis. The actual point of contact of the rear wheel with a ground surface is also displaced forwardly from an imaginary point of contact which would result with a vertical pivot axis.

In another embodiment of the invention, the axis of rotation of the front wheel with respect the front wheel truck is displaced rearwardly from the front pivot axis. In like manner, the axis of rotation of the rear wheel truck is displaced forwardly from the rear pivot axis.

In a preferred embodiment of the invention, a pivot restraining means is also connected to shafts which provide the pivotal movement of the trucks carrying the individual wheels. Further, an adjustable control means is connected to the pivot restraining means for selectively controlling the amount of pivotal movement provided through these pivot shafts. Various types of pivot control restraining means are shown in the present invention.

In a more preferred embodiment, the axis of rotation of the front wheel is displaced rearwardly from the front truck pivot axis by a distance equal to the distance between the axis of an axle holding the front wheel, that is the axis of rotation of the front wheel, to the central axis of the front pivot shaft and the axis of rotation of the rear wheel is displaced forwardly from the rear truck pivot axis by a distance equal to the distance between the axis of an axle holding the rear wheel, that is the axis of rotation of the rear wheel, to the central axis of the rear pivot shaft.

In still another preferred embodiment, the angle of displacement of the rear pivot axis from a vertical pivot axis is the same as the angle of displacement of the front pivot axis from a vertical pivot axis.

It has been found in connection with the present invention that wheels which are allowed to turn relative to the direction of movement of the platform are highly desirable. However, these wheels must have a certain resistance which tends to maintain the wheels in a straight line. The restraining means of the present invention accomplishes this result. By adjusting the restraining means, it is possible to accommodate the skateboard to the capability of and the weight of a particular user. The wheels of the skateboard are not allowed to turn about a steering pivot axis freely much in the same manner as a motorcycle. Rather, some force is required to overcome the resistance against the steering pivoting movement of the wheels. In this way, the rider effectively forces the wheels to turn in the direction of movement of the skateboard. In addition, by dampening the wheels, vibration in turning movement is reduced.

This invention possesses many other advantages and has other purposes which may be made more clearly apparent from a consideration of the forms in which it may be embodied. These forms are shown in the drawings forming a part of and accompanying the present specification. They will now be described in detail for purposes of illustrating the general principles of the invention. However, it is to be understood that the following detailed description and the accompanying drawings are not to be taken in a limiting sense.

BRIEF DESCRIPTION OF THE DRAWINGS

Figure 1:
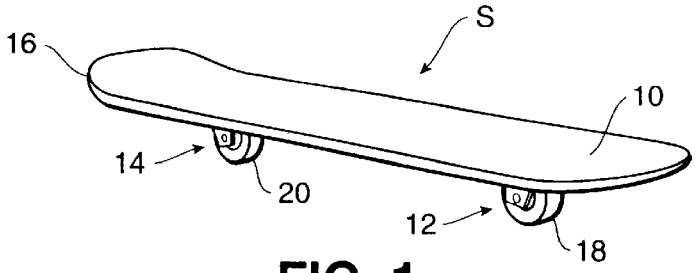
Figure 2:
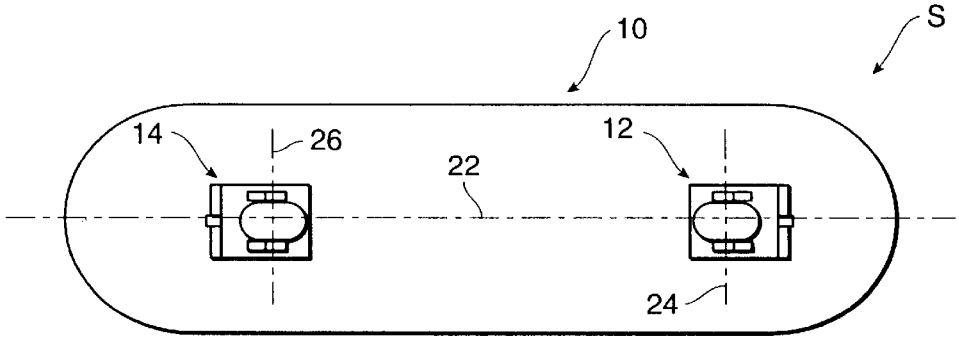
Figure 3:
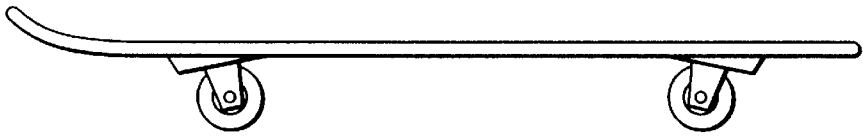
Figure 4:
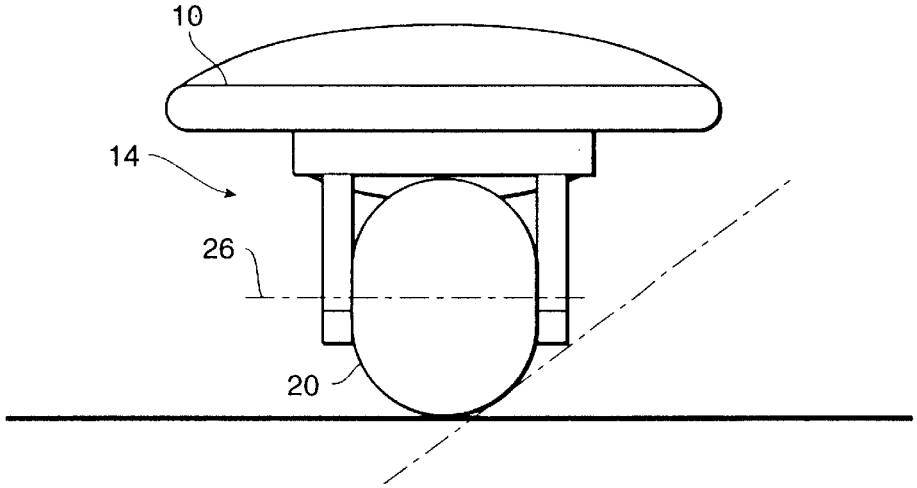
Figure 5:
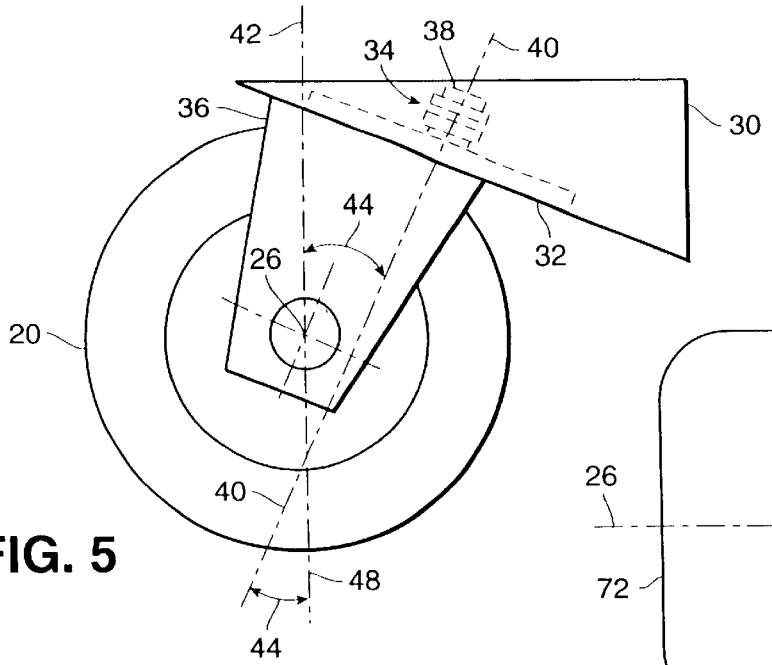
Figure 6:
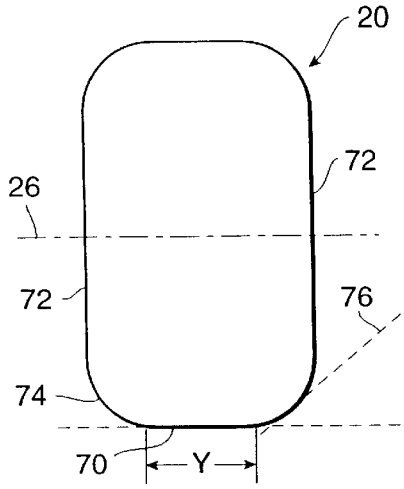
Figure 7:
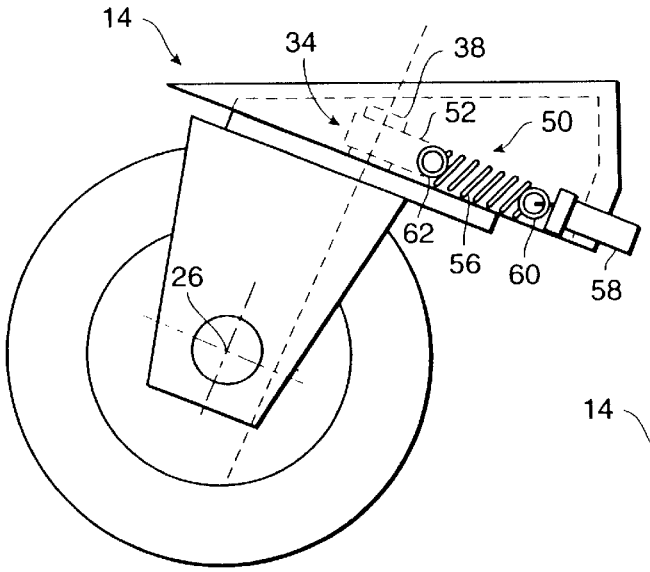
Figure 8:
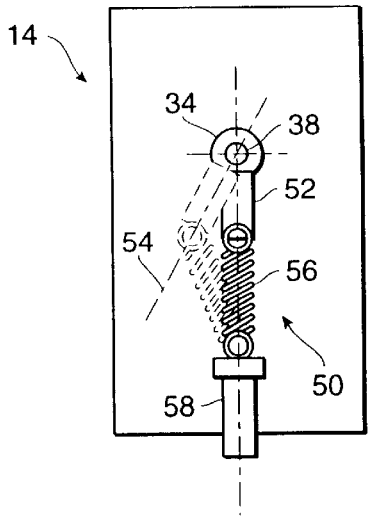
Figure 9:
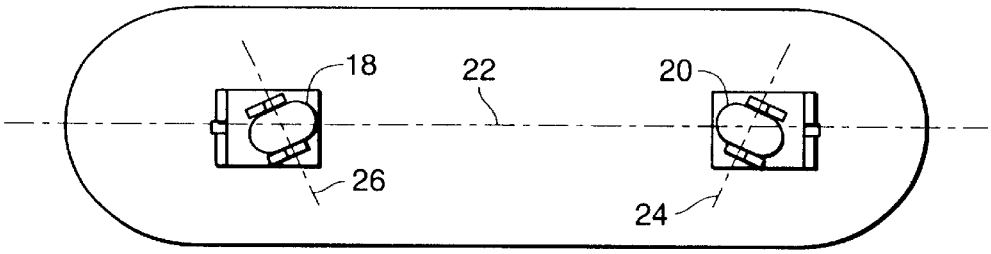
Figure 10:
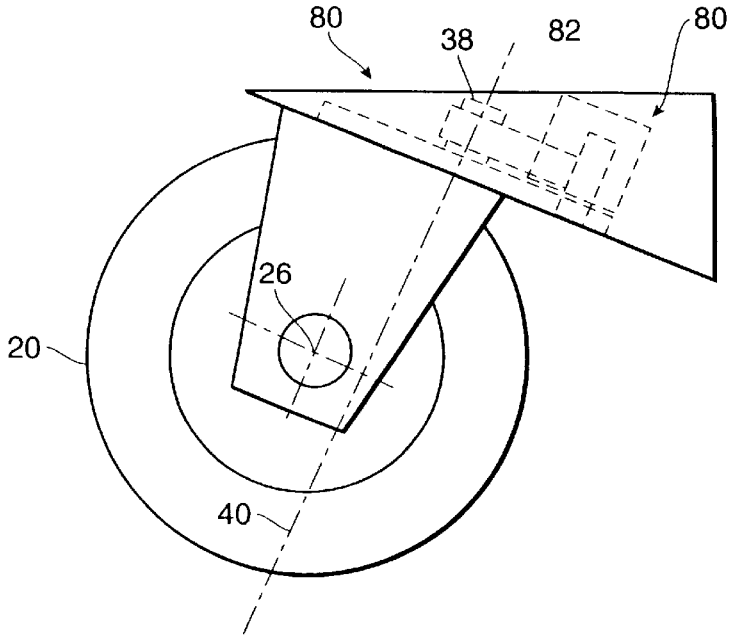
Figure 11:
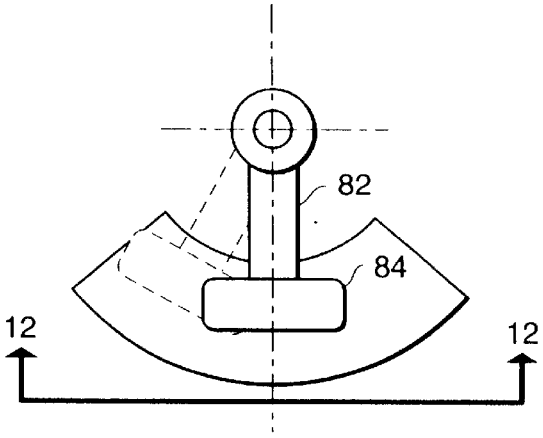
Figure 12:
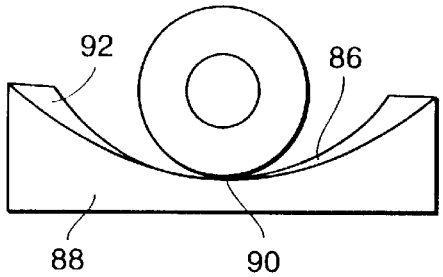

Having thus described the invention in general terms, reference will now be made to the accompanying drawings in which:

FIG. 1 is a perspective view of a skateboard constructed in accordance with and embodying the present invention;

FIG. 2 is a top plan view of the skateboard showing the mounting of rear and front wheel trucks on the skateboard;

FIG. 3 is a side elevational view of the skateboard of the invention;

FIG. 4 is a front elevational view of the skateboard showing the arrangement in which the wheels are in contact with a ground surface;

FIG. 5 is a schematic representation showing a wheel truck of the present invention and the relationship of the pivot axis with respect to a vertical axis for the mounting of the wheel on that truck;

FIG. 6 is a schematic view showing the angular relationship of surfaces on a wheel of the skateboard in accordance with the present invention;

FIG. 7 is a side elevational view of one form of wheel truck used on the skateboard of the present invention and showing the mechanism for restraining wheel steering movement;

FIG. 8 is a top plan view of the truck of FIG. 6 and showing in detail the mechanism for restraining wheel steering movement;

FIG. 9 is a schematic top plan view showing the angular position assumed by the front and rear wheels in a turning maneuver;

FIG. 10 is a side elevational view, similar to FIG. 6, and showing a modified form of wheel truck with a modified form of mechanism for restraining wheel steering movement;

FIG. 11 is an enlarged top plan view of a portion of the mechanism of FIG. 8 for restraining wheel steering movement; and FIG. 12 is a front elevational view of the mechanism of FIG. 9 taken substantially along the plan of line 12—12 of FIG. 11.

DETAILED DESCRIPTION OF A PREFERRED EMBODIMENT

Referring now in more detail and by reference characters to the drawings which illustrate a preferred embodiment of the present invention, S designates an inline skateboard having a platform 10 along with a front wheel truck 12 and a rear wheel truck 14, both of which are mounted on the underside of the platform 10. Moreover, by reference to FIG. 2, it can be observed that the front and rear wheel trucks are in alignment in the direction of movement of the skateboard.

The platform of the skateboard itself may be generally conventional. Thus, it may be made of any conventional material normally used in the production of skateboards. At its rearward end, the platform 10 is provided with an upwardly struck curved end 16.

By further reference to FIG. 2, it can be seen that a front wheel 18 mounted on the front wheel truck 12 and a rear wheel 20 mounted on the rear wheel truck 14 are in alignment with a longitudinal axis 22 passing through the skateboard and in the direction of movement of the skateboard. This is the position which would be adopted by the wheels 18 and 20 when the skateboard is moving in a straight forward direction. These wheels, however, would be capable of turning, that is, they would turn to be angularly located relative to the axis 22, e.g. as shown in FIG. 9, in a wheel steering movement when the skateboard is to be turned. Thus, an axis of rotation 24 passing through the front wheel would be angularly turned relative to the longitudinal center axis 22 and an axis of rotation 26 passing through the rear wheel 20 would also be angularly turned relative to the central axis 22 in any wheel steering movement.

Referring now to FIGS. 3–5 of the drawings, the mounting of a rear wheel, for example, with respect to the platform is shown in more detail. In FIG. 5, there is only shown a pivot axis for wheel steering movement but no restraining mechanism associated therewith. It can be seen that the wheel truck is provided with a mounting bracket 30 having an inclined bottom surface 32. A pivot mechanism 34 is secured to a yoke 36, the latter of which is located at the underside of the bottom wall 32 of the bracket 30. This pivot mechanism 34 comprises a pivot shaft 38 and which has a pivot axis 40. This pivot axis is actually the wheel steering axis of rotation.

FIG. 5 also shows a vertical axis 42 which would constitute a vertical pivot axis but which is displaced from the actual pivot axis 40 by an angle 44. Thus, and by reference to FIG. 5, it can be seen that the actual point of contact 48 which would be in coincidence with a vertical pivot axis 42 is rearwardly located from the actual pivot axis 40 by the angle 44.

It should also be understood that the front wheel truck 12 would have a construction similar to that shown for the rear wheel truck in FIG. 5. In essence, by merely rotating the rear wheel truck of FIG. 5 so that the bottom wall 32 slopes downwardly and forwardly, a front wheel truck would be provided. It can be observed in this respect that the front wheel would similarly have a pivot axis 40 displaced from a vertical pivot axis 42 by that same angle 44. In other words, the distance between the actual point of contact 48 of the front wheel to the pivot axis 40 for that front wheel would be the same as the distance between the point of contact 48 for the rear wheel and the pivot axis 40 for that rear wheel.

As indicated previously, great instability would result if either of the front or rear wheels were allowed to rotate about its pivot axis 40 freely. Thus, some restraining force must be applied to restrain movement about that pivot axis. FIGS. 7 and 8 more fully illustrate one preferred embodiment of a wheel steering restraining mechanism 50, which is in constructed in accordance with and embodies the present invention. This wheel steering it restraining mechanism 50 is shown for use on the rear wheel truck 14, although it should be understood that the same identical restraining mechanism could also be used on the front wheel truck 12.

The restraining mechanism 50 generally comprises an arm 52 mounted on and being rotatable with the pivot shaft 38. Thus, for example, the arm 52 can rotate with the pivot shaft 38 from the position which it would normally assume, as shown in the solid lines of FIG. 8, to the position as shown in the dotted lines of FIG. 8. Thus, the arm 52 would normally be aligned with the longitudinal axis 22. When the restraining mechanism is actuated to restrain wheel steering movement, the arm 52 could shift to an axis 54, as illustrated in FIG. 8. The arm 52 is restrained against movement by means of a spring 56 and the amount of tension of which can be controlled by an adjusting screw 58, as best shown in FIGS. 7 and 8. The screw 58 is secured to the spring through a collar 60 and the spring is secured to the arm 52 through another collar 62.

It can be seen that when a downward force is applied to one lateral side of the platform, that force will tend to cause the front wheel 18 to rotate in the opposite direction about its pivot axis. Thus, if a lateral downward force is applied on the right-side of the platform 10, the front wheel 18 will adopt a position to make a left turn. In like manner, that same force will cause the rear wheel 20 to rotate in an opposite direction about its pivot axis, such that the two pivot axes are now angularly disposed relative to one another. In this case, the wheels would adopt a position substantially as shown in FIG. 9 of the drawings with the axis of rotation of the front wheel 24 now being shifted angularly and the axis of rotation 26 of the rear wheel also being shifted angularly, in the manner as shown. However, by reference to FIG. 8, it can be seen that the spring 56 is also biased outwardly thereby attempting to bias movement of the arm 52 back to its original position. In this way, as a greater lateral force is applied to the platform, the greater will be the force imposed by the spring 56 tending to push the spring away from the axis 54 back to a position in alignment with the longitudinal axis 22 passing through the platform.

In accordance with the above-identified construction, it can be seen that the wheels are not freely rotatable about the pivot axis in the turning direction and that they must have a certain resistance applied to the pivot axis which tends to keep them in a straight direction. Although the wheels will be allowed to turn, the greater the turning force will generate a greater resistance to turning. Thus, turning cannot be accomplished in the same manner as a bicycle or a motorcycle. A user of the skateboard can adjust the amount of tension which would applied by the adjustment screw, as aforesaid. One with a greater ability would release the tension on the wheels permitting them to turn through their pivot axis in a wheel steering direction. Thus, the rider must actually force the wheels to turn.

The actual turning movement can be analogized somewhat to a surfboard. When a force is applied to a lateral side of the surfboard the board will cause the rear portion thereof to effectively "wash out", that is, to steer the board to the right against the pressure of the water. The same action actually results with the skateboard, in that, the rear wheel operating on the ground surface will cause the skateboard to turn to the right. The amount of angular relationship achieved by the rear wheel in any turning movement will depend on the speed of the skateboard, as well as the weight of the person using the skateboard. However, the maximum amount of lateral force which can be applied is effectively a function of the board construction.

In a conventional skateboard, there is a significant limitation on the lean angle. Inasmuch as the wheels are not capable of rotating about a turning axis relative to the platform, any substantial leaning will cause a tipping of the skateboard. Due to the fact that the wheels are capable of turning relative to the platform and the width of the wheels, the skateboard of the invention presents essentially no limitation on the lean angle. In effect, the turning of the skateboard becomes more like the actual turning of a surfboard with the rear of the surfboard being displaced (referred to as being "washed out") to cause the turning movement.

One of the important aspects of the invention is the fact that both the front and the rear wheels of the skateboard will turn relative to the platform in order to obtain a turning direction for the skateboard. Thus, not only do the wheels rotate for riding capability, but they also rotate about a pivot axis permitting this turning movement. Moreover, the wheels pivot in opposite directions, substantially as shown in FIG. 9, in order to achieve this turning operation and this is unlike any effective wheel construction in any prior art skateboard.

The wheels which are used in the skateboard of the invention normally have a slightly larger diameter that those found on conventional skateboards. As a result, balancing on the board is compromised. This tendency to compromise the balance is overcome by use of a unique type wheel construction in accordance with the present invention. FIGS. 4 and 6 more fully illustrate this wheel construction. It can be observed that the wheel of the invention has a generally flat annular riding surface 70 which also has relatively flat side walls 72. The flat annual wall or riding surface 70 is connected to the flat side walls 72 by means of arcuate sections 74. These arcuate sections have a cord 76 represented by the dotted lines in FIG. 6. Thus, these arcuate sections 74 provide an ideal turning surface when the skateboard is in a turning maneuver. This is analogous to the construction of a bicycle or motorcycle tire in which an arcuate riding surface is provided at the edge of the tire for use during turning maneuvers and which allows the bicycle or the motorcycle to be tipped in the direction of the turn.

Beyond the construction as shown in FIGS. 4 and 6, the wheel itself may be formed of those materials normally used in the formation of wheels on skateboards.

In a preferred embodiment of the invention, the wheels have a annular flat area which is about one inch in width. Moreover, they are preferably formed of a hard molded rubber as, for example, a neoprene type rubber. This type of construction of the wheel reduces the amount of potential vibration which might otherwise result if oscillations were imparted to the skateboard. Thus, this construction dampens potential wheel vibration.

In a more preferred embodiment, the cord 76 adopts an angle of between about fifteen degrees to about sixty degrees and preferably about twenty to twenty-five degrees. Moreover, the dimension Y, as illustrated in FIG. 6, has a width which is approximately one-third to about one-eighth of the overall height of the flat wall 72 in a preferred embodiment.

FIGS. 10–12 illustrate another modified form of restraining mechanism 80 for restraining turning movement about a pivot axis of a wheel. The restraining mechanism 80 is also provided with an arm 82 which is coupled to and rotatable with the shaft 38 and which is rotatable about an axis 40. In this case, the arm 82 is connected to a friction wheel 84 which rides against an arcuate upwardly presented surface 86 of a steering block 88. It can be seen that the arcuate upper surface 86 has a low point 90 and which increases toward high end points 92. Thus, as a lateral force is applied to the skateboard which tends to turn the wheel 20, there will be a counter-acting force tending to restrain turning movement of the wheel 20 about the pivot axis 40. As the arm 82 is forced to move outwardly by the rider as, for example, to the position as shown in the dotted lines of FIG. 11, an increased resistance is generated to further turning movement of the shaft 38. This tends to restrain turning movement of the entire rear wheel 20 about its pivot axis.

It should be recognized that those mechanisms as illustrated in FIGS. 7 and 8 and the mechanisms illustrated in FIGS. 10–12 are only illustrative of two of the types of restraining mechanisms which could be used in the present invention. Numerous other devices which could be used to apply a restraining force to the shaft 38 can also be used.

Thus, there has been illustrated and described a unique and novel skateboard which has a unique and highly improved steering ability and maneuverability without sacrificing stability. Thus, the skateboard of the invention thereby fulfills all of the objects and advantages which have been sought. It should be understood that many changes, modifications, variations and other uses and applications will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. An inline skateboard capable of being propelled by leg motion of a rider and which enables a substantial turning control through lateral force applied to a single inline front wheel and to a single inline rear wheel applied by a rider, said skateboard comprising:

a) a platform for supporting a rider on the skateboard;

b) a front wheel truck secured to an underside of said platform and having a single front wheel with arcuate edges engageable with a ground surface in response to a force applied to said front wheel causing said front wheel to ride on one of said arcuate edges to enable a turning of the skateboard, said front wheel being movable about a front pivot axis passing through said platform at an angle displaced from a vertical pivot axis;

c) a point of contact of the front wheel with a ground surface being displaced rearwardly of a point where a horizontal plane passing through the axis of rotation of the front wheel intersects the front pivot axis and rearwardly of a point of contact which would result with a vertical axis passing through that point when the horizontal plain intersects the front pivot axis;

d) a rear wheel truck secured to an underside of said platform and having a single inline rear wheel with arcuate edges engageable with a ground surface in response to a force applied to said rear wheel causing said rear wheel to ride on one of said arcuate edges to thereby enable a turning of the skateboard, said rear wheel being movable about a rear pivot axis passing through the platform at an angle displaced from a vertical pivot axis; and e) a point of contact of the rear wheel with a ground surface being displaced forwardly from a point of contact which would result with a vertical pivot axis.

2. The inline skateboard of claim 1 further characterized in that said front wheel truck is mounted to an underside of said platform through a front pivot shaft which allows for pivotal movement through said front pivot axis, and said rear wheel truck is mounted to an underside of said platform through a rear pivot shaft which allows for pivotal movement through said rear pivot axis.

3. The inline skateboard of claim 2 further characterized in that pivot restraining means is operatively connected to at least one of said shafts to control the amount of pivotal movement of said shaft.

4. The inline skateboard of claim 3 further characterized in that adjustable control means is connected to said pivot restraining means for selectively controlling the amount of pivotal movement provided through that pivot shaft.

5. The inline skateboard of claim 2 further characterized in that pivot restraining means is operatively connected to each of said pivot shafts to control the amount of pivot movement of each of said shafts, and adjustable control means is connected to each pivot restraining means for selectively controlling the amount of pivotal movement provided by each said pivot shaft.

6. An inline skateboard capable of being propelled by leg motion of a rider and which enables a substantial turning control through lateral force applied by a rider, said skateboard comprising:

a) a platform for supporting a rider on the skateboard;

b) a front wheel truck secured to an underside of said platform and having a front wheel movable about a front pivot axis passing through said platform at an angle displaced from a vertical pivot axis;

c) the axis of rotation of said front wheel with respect to said front wheel truck being displaced rearwardly from a point where a horizontal plane passing through the axis of rotation of said front wheel intersects the front pivot axis;

d) a rear wheel truck secured to an underside of said platform and having a rear wheel movable about a rear pivot axis passing through the platform at an angle displaced from a vertical pivot axis; and e) the axis of rotation of said rear wheel with respect to said rear wheel truck being displaced forwardly of a point where a horizontal plane passing through the axis of rotation of said rear wheel intersects the rear pivot axis.

7. The inline skateboard of claim 6 further characterized in that an actual point of contact of the front wheel with a ground surface being displaced rearwardly of an imaginary point of contact which would result with a vertical pivot axis, and that an actual point of contact of the rear wheel with a ground surface being displaced forwardly from an imaginary point of contact which would result with a vertical pivot axis.

8. The inline skateboard of claim 6 further characterized in that said front wheel truck is mounted to an underside of said platform through a front pivot shaft which allows for pivotal movement through said front pivot axis, and said rear wheel truck is mounted to an underside of said platform through a rear pivot shaft which allows for pivotal movement through said rear pivot axis.

9. The inline skateboard of claim 8 further characterized in that pivot restraining means is operatively connected to at least one of said shafts to control the amount of pivotal movement of said shaft.

10. The inline skateboard of claim 8 further characterized in that the axis of rotation of the front wheel is displaced rearwardly from the front pivot axis by a distance equal to the distance between the axis of an axle holding the front wheel to said front pivot axis and where the front pivot axis is coincident with the front pivot shaft, and the axis of rotation of said rear wheel is displaced forwardly from the rear pivot axis by a distance equal to the distance between the axis of an axle holding the front rear to the rear pivot axis and where the rear pivot axis is coincident with the rear pivot shaft.

11. An inline skateboard capable of being propelled by leg motion of a rider and which enables a substantial turning control through lateral force applied by a rider, said skateboard comprising:

a) a platform for supporting a rider on the skateboard;

b) a front wheel truck secured to an underside of said platform and having a front wheel movable about a front pivot axis passing through said platform at an angle displaced from a vertical pivot axis;

c) a point of contact of the front wheel with a ground surface being displaced rearwardly of a point of contact which would result with a vertical axis;

d) a rear wheel truck secured to an underside of said platform and having a rear wheel movable about a rear pivot axis passing through the platform at an angle displaced from a vertical pivot axis; and e) a point of contact of the rear wheel with a ground surface being displaced forwardly from a point of contact which would result with a vertical pivot axis;

f) said front wheel truck being mounted to an underside of said platform through a front pivot shaft which allows for pivotal movement through said front pivot axis;

g) said rear wheel truck being mounted to an underside of said platform through a rear pivot shaft which allows for pivotal movement through said rear pivot axis; and h) pivot restraining means operatively connected to at least one of said front pivot shaft or rear pivot shaft to control the amount of pivotal movement of said shaft, said pivot restraining means comprises a roller means connected to said shaft in which pivotal movement is controlled and which roller means rides in a steering block where the restraining force restraining pivotal movement increases proportionally to the force applied to cause pivotal movement thereof.

12. An inline skateboard capable of being propelled by leg motion of a rider and which enables a substantial turning control through lateral force applied by a rider, said skateboard comprising:

a) a platform for supporting a rider on the skateboard;

b) a front wheel truck secured to an underside of said platform and having a front wheel movable about a front pivot axis passing through said platform at an angle displaced from a vertical pivot axis;

c) a point of contact of the front wheel with a ground surface being displaced rearwardly of a point of contact which would result with a vertical axis;

d) said front pivot axis leading the axis of rotation of said front wheel in the direction of movement of said front wheel truck at a horizontal plane passing through said axis of rotation of said front wheel;

e) a rear wheel truck secured to an underside of said platform and having a rear wheel movable about a rear pivot axis passing through the platform at an angle displaced from a vertical pivot axis; and f) a point of contact of the rear wheel with a ground surface being displaced forwardly from a point of contact which would result with a vertical pivot axis.

13. The inline skateboard of claim 12 further characterized in that said rear pivot axis trails the axis of rotation of said rear wheel in the direction of movement of said rear wheel truck at a horizontal plane passing through the axis of rotation of said rear wheel.

14. The inline skateboard of claim 13 further characterized in that said front wheel truck is mounted to an underside of said platform through a front pivot shaft which allows for pivotal movement through said front pivot axis, and said rear wheel truck is mounted to an underside of said platform through a rear pivot shaft which allows for pivotal movement through said rear pivot axis.

15. The inline skateboard of claim 14 further characterized in that pivot restraining means is operatively connected to at least one of said shafts to control the amount of pivotal movement of said shaft.

16. The inline skateboard of claim 15 further characterized in that adjustable control means is connected to said pivot restraining means for selectively controlling the amount of pivotal movement provided through that pivot shaft.

17. The inline skateboard of claim 14 further characterized in that pivot restraining means is operatively connected to each of said pivot shafts to control the amount of pivot movement of each of said shafts, and adjustable control means is connected to each pivot restraining means for selectively controlling the amount of pivotal movement provided by each said pivot shaft.

18. An inline skateboard capable of being propelled by leg motion of a rider and which enables a substantial turning control through lateral force applied by a rider, said skateboard comprising:

a) a platform for supporting a rider on the skateboard;

b) a front wheel truck secured to an underside of said platform and having a front wheel rotatable about a front axis of rotation;

c) a front pivot shaft connecting said front wheel truck to said platform and being pivotally movable about a front pivot axis passing through said platform at an angle which is angularly displaced from a vertical pivot axis;

d) a point of contact of the front wheel with a ground surface being displaced rearwardly of a point of contact which would result with a vertical axis;

e) front wheel biasing means on said front wheel truck to bias said front wheel to an initial position where said front wheel axis of rotation lies in a plane perpendicular to a longitudinal axis passing through said platform and with the biasing force being increased proportionally in response to the turning force tending to cause said front wheel to turn about the front pivot axis away from said initial position, said front wheel biasing means acting on said front pivot shaft at a point substantially forwardly of the axis of rotation of said front wheel;

f) a rear wheel truck secured to an underside of said platform and having a rear wheel rotatable about a rear wheel axis of rotation;

g) a rear pivot shaft connecting said rear wheel truck to said platform and being pivotally movable about a rear pivot axis passing through the platform at an angle which is angularly displaced from a vertical pivot axis;

h) a point of contact of the rear wheel with a ground surface being displaced forwardly from a point of contact which would result with a vertical pivot axis;

i) rear wheel biasing means on said rear wheel truck to bias said rear wheel to an initial position where said rear when axis of rotation lies in a plane perpendicular to a longitudinal axis passing through said platform and with the biasing force being increased proportionally in response to the turning force which tends to cause said rear wheel to turn about the rear pivot axis away from said initial position, said rear wheel biasing means acting on said rear pivot shaft at a point substantially rearwardly of the axis of rotation of said rear wheel;

j) pivot restraining means operatively connected to at least one of said shafts to control the amount of pivotal movement of said shaft; and k) adjustable control means connected to said pivot restraining means for selectively controlling the amount of pivotal movement provided through that pivot shaft upon which the pivot retraining means acts.

19. The inline skateboard of claim 18 further characterized in that pivot restraining means is operatively connected to each of said pivot shafts to control the amount of pivot movement of each of said shafts, and adjustable control means is connected to each pivot restraining means for selectively controlling the amount of pivotal movement provided by each said pivot shaft.

* * * * *